US008087204B1

(12) United States Patent
Sorkin

(10) Patent No.: US 8,087,204 B1
(45) Date of Patent: Jan. 3, 2012

(54) SEALING CAP FOR INTERMEDIATE ANCHOR SYSTEM

(76) Inventor: Felix L. Sorkin, Stafford, TX (US)

( * ) Notice: Subject to any disclaimer, the term of this patent is extended or adjusted under 35 U.S.C. 154(b) by 698 days.

(21) Appl. No.: 12/169,298

(22) Filed: Jul. 8, 2008

(51) Int. Cl.
*E04C 5/08* (2006.01)

(52) U.S. Cl. ..... 52/223.13; 52/223.14

(58) Field of Classification Search ..... 403/365, 403/311, 312; 52/223.13, 223.14, 301
See application file for complete search history.

(56) References Cited

U.S. PATENT DOCUMENTS 3,534,989 A * 10/1970 Yonkers ..... 403/369
4,146,951 A * 4/1979 Howlett ..... 29/452
4,918,887 A * 4/1990 Davis et al. ..... 52/223.13
5,072,558 A * 12/1991 Sorkin et al. ..... 52/223.13
5,079,879 A * 1/1992 Rodriguez ..... 52/223.13
5,347,777 A * 9/1994 Sudduth ..... 52/223.13
5,630,301 A * 5/1997 Sieg ..... 52/223.13
5,770,286 A * 6/1998 Sorkin ..... 428/36.9
5,839,235 A * 11/1998 Sorkin ..... 52/223.13
5,897,102 A * 4/1999 Sorkin ..... 254/29 A
6,151,850 A * 11/2000 Sorkin ..... 52/223.13
6,354,596 B1 * 3/2002 Rodriguez ..... 277/317
6,560,939 B2 * 5/2003 Sorkin ..... 52/223.13
6,684,585 B2 * 2/2004 Campbell ..... 52/223.13
6,843,031 B1 * 1/2005 Sorkin ..... 52/223.13

* cited by examiner

*Primary Examiner* — Jessica Laux
(74) *Attorney, Agent, or Firm* — Egbert Law Offices PLLC

(57) ABSTRACT

A sealing cap for an anchor of a post-tension anchorage system has a tubular body, a flange formed on an end of the tubular body, and a seal positioned adjacent an interior wall of the tubular body. The flange has a connector formed on a circumferential surface thereof for detachably engaging the flange with a tubular section of the anchor. The seal is positioned against the interior wall of the tubular body. The seal has a tubular shape so as to extend entirely around the interior wall. The seal is positioned in liquid-tight relation between the interior wall of the tubular body and a sheathed portion of a tendon extending from the anchor. The seal is inserted between the sheathed portion and the interior wall of the tubular body.

17 Claims, 2 Drawing Sheets

SEALING CAP FOR INTERMEDIATE ANCHOR SYSTEM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to post-tension anchorages. More particularly, the present invention relates to anchors used in such post-tension anchorages. More particularly, the present invention the relates to the sealing of an intermediate anchor.

2. Description of Related Art Including Information Disclosed Under 37 CFR 1.97 and 37 CFR 1.98

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile-strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual concrete members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges or threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Anchors known as "intermediate anchors" exist between the "live-end" and "dead-end" for concrete slabs having great lengths. To fix the tendon in any of these anchors, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. The tendon in a dead-end anchor can be tightened in the factory and then shipped, along with the full length of tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult because the tendon can have a considerable length and because the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the sheathing. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead-end anchorage, the end of the sheathing will tend to shrink slowly away from the dead-end anchorage.

The problem that affects many anchorage systems is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

Over time, it was found that the use of corrosion-protection tubes could be avoided by using a sheathing lock on the end of an intermediate anchor. The sheathing lock generally holds the sheathing of a tendon adjacent the end of an intermediate anchor that faces the dead-end anchor in a post-tension anchor system. Various patent applications, filed by the present inventor, address different sheathing locks: U.S. patent application Ser. No. 11/861,185, filed on Sep. 25, 2007, entitled "Apparatus for Preventing Shrinking of a Sheathing Over a Tendon"; U.S. patent application Ser. No. 11/933,029, filed on Oct. 31, 2007, entitled "Shrinkage Preventing Device for the Sheathing if a Tendon"; U.S. patent application Ser. No. 11/933,041, filed on Oct. 31, 2007, entitled "Shrinkage Preventing Apparatus for the Sheathing of a Tendon"; U.S. patent application Ser. No. 11/950,295, filed on Dec. 4, 2007, entitled "Unitary Sheathing Wedge"; and U.S. patent application Ser. No. 12/100,066, filed on Apr. 9, 2007, entitled "Sheathing Lock".

The use of the sheathing locks of the above-mentioned patent applications has given rise for the need for a seal on the end of an intermediate anchor opposite the sheathing lock. To tension the tendon of an intermediate anchor, the sheathing of the tendon must be cut at the end of the intermediate anchor. The sheathing is then pulled away from the end of the intermediate anchor so as to allow a tendon-tensioning device to be applied to the end of the intermediate anchor. Once the tendon has been tensioned, the sheathing that was cut on the end of the intermediate anchor is then placed adjacent the end of the intermediate anchor by sliding the sheathing on the outer surface of the tendon. Thus, there is a need for a sealing device so as to prevent the entry of moisture and other contaminants into the space between the sheathing and the end of the intermediate anchor.

It is an object of the present invention to provide a sealing cap for an intermediate anchor of a post-tension anchor system.

It is another object of the present invention to provide a sealing cap that effectively seals between the end of the intermediate anchor and the sheathing of the tendon.

It is another object of the present invention to provide a sealing cap that can easily slide over the sheathing of a tendon.

It is another object of the present invention to provide a sealing cap that creates a liquid-tight seal.

It is still another object of the present invention to provide a sealing cap for an intermediate anchor that has a removable seal.

It is another object of the present invention to provide a sealing cap that is easy to install and easy to use.

It is another object of the present invention to provide a sealing cap that is easy to manufacture and inexpensive.

These and other objects and advantages of the present invention will become apparent from a reading of the attached specification and appended claims.

BRIEF SUMMARY OF THE INVENTION

The present invention is a sealing cap for an anchor of a post-tension anchorage system, where the anchor has a tubular section at one end thereof, comprising a tubular body having an interior wall, a flange formed on an end of the tubular body, and a seal positioned adjacent the interior wall of the tubular body. The flange has a connecting means formed on a circumferential surface thereof for engaging the flange with the tubular section of the anchor. The seal is removably received in liquid-tight relation against the interior wall of the tubular body. The seal has a tubular shape so as to extend entirely around the interior wall. The seal is formed of a material different than a material of the tubular body. The seal can have a split extending longitudinally through a wall thereof. The tubular body is formed of a generally rigid material. The seal is formed of a material more pliable than the material of the tubular body.

A post-tension anchorage comprises an anchor member, a polymeric encapsulation covering the anchor member, and a sealing cap positioned adjacent the end of the anchor member. The polymeric encapsulation has a tubular section extending outwardly from an end of the anchor member. The connecting means of the sealing cap engages the flange with the tubular section of the polymeric encapsulation. A tendon extends through the anchor member and through the sealing cap. The seal is in liquid-tight relation with a surface of the tendon. The tendon has a sheathed portion and an unsheathed portion. The unsheathed portion is affixed within a cavity of the anchor member. The seal is in liquid-tight relation with the sheathed portion of the tendon. A sheathing lock is affixed to the sheathed portion of the tendon so as to fix the sheathed portion to the anchor member. The sheathing lock is affixed to an end of the anchor opposite the sealing cap.

DETAILED DESCRIPTION OF THE INVENTION

Figure 1:
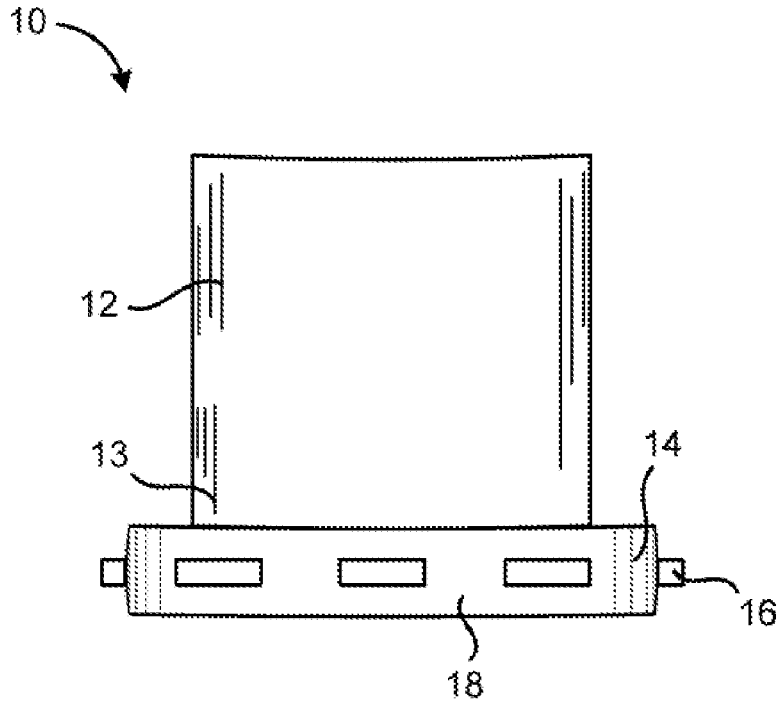
FIG. 1 shows a side elevational view of the preferred embodiment of the sealing cap of the present invention.

Referring to FIG. 1, there is shown a side elevation view of the preferred embodiment of the sealing cap 10 of the present invention. The sealing cap 10 has a tubular body 12. A flange 14 is formed on an end 13 of the tubular body 12. The tubular body 12 is concentric with the flange 14. A connecting means 16 is formed on the circumferential surface 18 of the flange 14.

Figure 2:
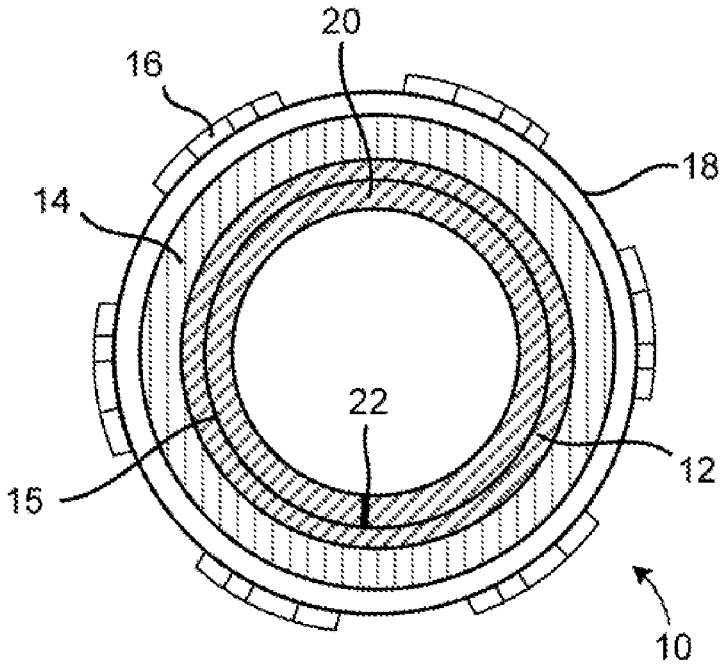
FIG. 2 shows an end elevational view of the preferred embodiment of the sealing cap of the present invention.

Referring to FIG. 2, there is shown an end elevational view of the sealing cap 10 of the present invention. The tubular body 12 can be seen as concentric with the flange 14. The connecting means 16 extends radially outwardly from the circumferential surface 18 of the flange 14. The seal 20 is removably received in liquid-tight relation against the interior wall 15 of the tubular body 12. The seal 20 is tubular in shape so as to extend entirely around the interior wall 15. The seal 20 is concentric with the tubular body 12 and with the flange 14. The seal 20 can be formed of an elastomeric or a polymeric material. The material of the seal 20 is different than the material of the tubular body 12. The seal 20 is formed of a material that is more pliable and resilient than the material of the tubular body 12. The flange 14 and tubular body 12 are integrally formed of a polymeric material. The material of the tubular body 12 is a generally rigid material. The connecting means 16 protrude outwardly from the circumferential surface 18 of the flange 14 so as to allow the sealing cap 10 of the present invention to be removably attached to an end of an anchor. A split 22 is formed in the seal 20. The split 22 runs longitudinally along the seal 20. The split 22 allows the seal 20 to be easily and flexibly installed. The compression forces that are placed on the seal by the cap 10 and by the anchor 30 cause the split 22 to close so as to form a liquid-tight seal against the sheathing 52 of the tendon 50. The split 22 allows the seal 20 to be easily spread open so as to allow the seal 20 to be applied over a tendon 50 against the tubular body 12.

Figure 3:
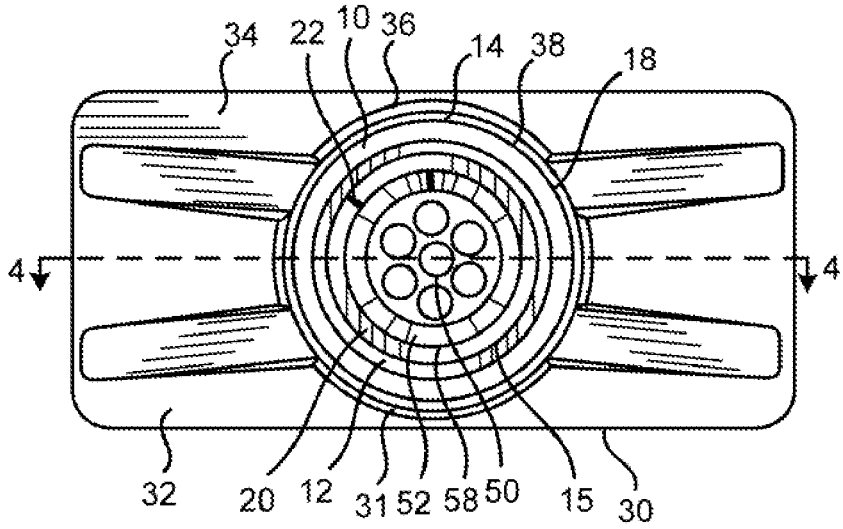
FIG. 3 shows an end elevational view of the preferred embodiment of the anchorage of the present invention.

Referring to FIG. 3, there is shown an end elevational view of the preferred embodiment of the anchor 30 of the present invention. The anchor 30 has a polymeric encapsulation 34 covering an anchor member 32. The sealing cap 10 is shown as positioned adjacent an end 31 of the anchor 30. A tubular section 36 extends outwardly from the polymeric encapsulation 34 and the anchor member 32. The cap 10 is shown as inserted into the tubular section 36 and in snap-fit relation with the protrusion 38 that extends radially inwardly from the tubular section 36. A tendon 50 is shown as inserted through the anchor 30 and the sealing cap 10. The tendon 50 has a sheathing 52. The sheathing 52 has a sheathed portion 58 that extends into the anchor 30. Sheathed portion 58 also extends through the interior wall 15 of the tubular body 12 of the sealing cap 10 so as to be in liquid-tight relationship with the seal 20 that is removably attached to the interior wall 15 of the tubular body 12. The sheathing 52 of the tendon 50 is concentric relationship with the seal 20 of the sealing cap 10.

Figure 4:
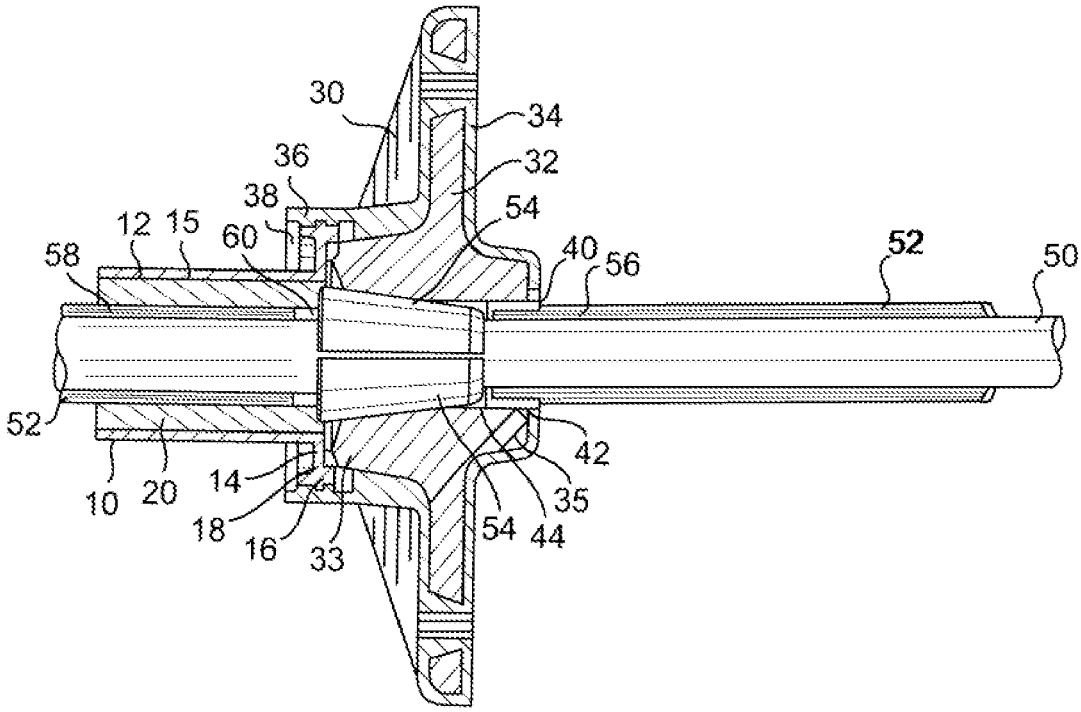
FIG. 4 shows a cross-sectional view of the preferred embodiment of the anchorage of the present invention taken along sight line 4-4 of FIG. 3.

Referring to FIG. 4, there is shown a cross-sectional view of the preferred embodiment of the anchorage of the present invention taken along sight line 4-4 of FIG. 3. The anchorage has a sealing cap 10, an anchor 30, and an sheathing lock 40. Preferably, the system is used on an intermediate anchor 30 of a post-tension anchor system. The polymeric encapsulation 34 can be seen as covering the anchor member 32 of the anchor 30. The tubular section 36 protrudes from the end 33 of the anchor member 32. The tubular section 36 is integrally formed with the polymeric encapsulation 34. A protrusion 38 extends radially inwardly from the tubular section 36. A tendon 50 is inserted within the anchor member 32, and extends through the anchor member 32 and the polymeric encapsulation 34 and the tubular section 36. A sheathing 52 is wrapped around the tendon 50. The sheathing 52 extends partially within the interior of the anchor member 32. An unsheathed portion 60 of the tendon 50 extending within the anchor member 32 is affixed within the cavity 44 of the anchor member 32 by wedges 54. A sheathing lock 40 is placed between the inner wall 42 of the cavity 44 of the anchor member 32 and the sheathing 52 of the tendon 50. The sheathing lock 40 is configured so as to hold the sheathing 52 that is shown to partially extend into the cavity 44 of the anchor member 32 within the cavity 44 of the anchor member 32. The sheathing lock 40 acts to resist the shrinkage forces of the sheathing 52 of the tendon 50 that exists when the anchor 30 is an intermediate anchor of a post-tension system. If the anchor 30 were to have a trumpet extending from the opposite end 35, then the sheathing lock 40 could also be configured to retain the sheathing 52 within the trumpet.

In the embodiment illustrated in FIG. 4, the flange 14 of the sealing cap 10 is snapped past the protrusion 38 that extends radially inwardly from the tubular section 36 of the polymeric encapsulation 34 of the anchor 30. The connecting means 16 of the sealing cap 10 keeps the sealing cap 10 fixed within the tubular section 36. A protrusion 38 also helps keep the sealing cap 10 fixed within the tubular section 36 of the anchor 30. The tubular body 12 of the sealing cap 10 has a diameter suitable for retaining the seal 20, the sheathing 52 and the tendon 50 therein. The seal 20 is positioned between the interior wall 15 of the tubular body 12 and the sheathing 52 of the tendon 50. The seal 20 effectively keeps moisture from entering the interior of the anchor 30. The sheathing lock 40 also helps prevent moisture from entering the interior of the anchor 30. The sealing cap 10 is positioned adjacent the end 33 of the anchor member 32. The sheathing lock 40 is positioned adjacent the opposite end 35 of the anchor member 32. The seal 20 can be placed on the interior wall of the tubular body 12 prior to inserting the tendon 50 and sheathing 52 therein. Or, the seal 20 can be placed between the interior wall 15 of the tubular body 12 and the sheathing of the tendon 50 after the tendon 50 and sheathing 52 have been placed within the tubular body 12. The opposite end 35 of the anchor member 32 faces the dead-end anchor of the post-tension anchor system. The end 33 of the anchor member 32 faces the live-end anchor of the post-tension anchor system. Thus, the anchor 30 of the preferred embodiment is an intermediate anchor. The seal 20 has a tubular shape.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A sealing cap for an anchor of a post-tension anchorage system, the anchor having a tubular section at one end of the sealing cap, comprising:

a tubular body having an interior wall, said tubular body having a length dimension extending from one end to an opposite end thereof;

a flange formed on said one end of said tubular body and extending outwardly therefrom, said flange having a connecting means formed on a circumferential surface thereof for engaging with the tubular section of the anchor; and a seal positioned adjacent said interior wall of said tubular body, said seal extending entirely along said length dimension of said tubular body; said seal having a split extending longitudinally through a wall thereof.

2. The sealing cap of claim 1, said seal being removably received in liquid-tight relation against said interior wall of said tubular body.

3. The sealing cap of claim 1, said seal having a tubular shape so as to extend entirely around said interior wall.

4. The sealing cap of claim 3, said seal being formed of a material different than a material of said tubular body.

5. The sealing cap of claim 1, said tubular body being formed of a generally rigid material, said seal being formed of a more pliable material than said material of said tubular body.

6. A post-tension anchorage comprising:

an anchor member; a polymeric encapsulation covering said anchor member, said polymeric encapsulation having a tubular section extending outwardly from an end of said anchor member; and a sealing cap positioned adjacent said end of said anchor member, said sealing cap having a tubular body, said sealing cap having a connecting means formed on a circumferential surface thereof for engaging with said tubular section of said polymeric encapsulation, said sealing cap having a seal positioned against an interior wall of said tubular body, said seal having a split extending longitudinally through a wall thereof; and said seal having a length equal to an entire length of said tubular body.

7. The anchorage of claim 6, said seal being removably received in liquid-tight relation against said interior wall of said tubular body.

8. The anchorage of claim 7, said seal having a tubular shape so as to extend entirely around said interior wall.

9. The anchorage of claim 8, said seal being formed of a material that is different than a material of said tubular body.

10. The anchorage of claim 6, said tubular body being formed of a generally rigid material, said seal being formed of a more pliable material than said material of said tubular body.

11. The anchorage of claim 6, further comprising:

a tendon extending through said anchor member and through said sealing cap, said seal being in liquid-tight relation with a surface of said tendon.

12. The anchorage of claim 11, said tendon having a sheathed portion and an unsheathed portion, said unsheathed portion being affixed within a cavity of said anchor member, said seal being in liquid-tight relation with said sheathed portion of said tendon.

13. The anchorage of claim 11, further comprising:

a sheathing lock affixed to said sheathed portion of said tendon so as to fix said sheathed portion to said anchor member.

14. The anchorage of claim 13, said sheathing lock affixed to an end of said anchor opposite said sealing cap.

15. An apparatus comprising:

an anchor member having a cavity on an interior wall thereof;

a tendon having a sheathed portion and an unsheathed portion, said unsheathed portion being affixed within said cavity of said anchor member;

a sealing cap affixed adjacent an end of said anchor member, said sealing cap having a tubular body and a seal positioned against an interior wall of said tubular body, said seal being in liquid-tight relation with said sheathed portion of said tendon; said seal extending entirely along a length dimension of said tubular body, said seal having a split extending longitudinally through a wall thereof;

a polymeric encapsulation covering said anchor member, said polymeric encapsulation having a tubular section extending outwardly from said end of said anchor member, said sealing cap having a connecting means thereon for engaging with said tubular section of said polymeric encapsulation, said seal being positioned in said tubular body so as to have an end bearing against said anchor member.

16. The apparatus of claim 15, said sealing cap having an open end opposite said anchor member, said tendon extending through said open end.

17. The apparatus of claim 15, said seal being of a more pliable material than a material of said interior wall.

* * * * *